US011735089B2

(12) United States Patent
Nam et al.

(10) Patent No.: US 11,735,089 B2
(45) Date of Patent: Aug. 22, 2023

(54) DISPLAY DEVICE AND METHOD OF OPERATING THE SAME

(71) Applicant: LG ELECTRONICS INC., Seoul (KR)

(72) Inventors: Yeonoh Nam, Seoul (KR); Jongmin Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/304,416

(22) Filed: Jun. 21, 2021

(65) Prior Publication Data

US 2022/0366827 A1 Nov. 17, 2022

(30) Foreign Application Priority Data

May 17, 2021 (KR) ..... 10-2021-0063504

(51) Int. Cl.
*G09G 3/20* (2006.01)

(52) U.S. Cl.
CPC ..... *G09G 3/2003* (2013.01); *G09G 2320/02* (2013.01)

(58) Field of Classification Search
CPC ..... G06F 12/0207; G06F 12/0292; G06F 2212/1024; G09G 2340/06; G09G 5/06; G06T 1/60
See application file for complete search history.

(56) References Cited

U.S. PATENT DOCUMENTS

2009/0096815 A1* 4/2009 Fukuda ..... G09G 5/02 345/690
2011/0012920 A1* 1/2011 Saigo ..... H04N 1/6058 345/600
2011/0128438 A1* 6/2011 Yamashita ..... H04N 1/6058 348/E11.006
2013/0335439 A1 12/2013 Jeong et al.
2015/0199939 A1* 7/2015 Takahashi ..... G09G 5/02 345/590
2017/0237962 A1 8/2017 Oh et al.
2018/0018793 A1* 1/2018 Min ..... G06T 11/001
2018/0182353 A1 6/2018 Chen et al.
(Continued)

FOREIGN PATENT DOCUMENTS

JP 2013115588 6/2013
JP 2015192419 11/2015
(Continued)

OTHER PUBLICATIONS

European Patent Office Application Serial No. 21181041.1, Search Report dated Dec. 17, 2021, 18 pages.
(Continued)

*Primary Examiner* — Kenneth Bukowski
(74) *Attorney, Agent, or Firm* — Lee, Hong, Degerman, Kang & Waimey PC

(57) ABSTRACT

A display device according to an embodiment of the present application comprises a storage configured to store gamut mapping data, a controller configured to, when an image signal is input, convert the input image signal into an output signal based on the gamut mapping data, and a display configured to display an image based on the output signal, wherein the controller changes the gamut mapping data according to the input image signal.

9 Claims, 15 Drawing Sheets

(56) References Cited

U.S. PATENT DOCUMENTS

| | | | | |
|---|---|---|---|---|
| 2018/0233075 | A1 | 8/2018 | Boyd | |
| 2018/0276787 | A1 | 9/2018 | Chen et al. | |
| 2018/0367778 | A1* | 12/2018 | Borer | H04N 1/6027 |
| 2019/0325802 | A1 | 10/2019 | Aly | |

FOREIGN PATENT DOCUMENTS

| | | |
|---|---|---|
| KR | 1020130141920 | 12/2013 |
| WO | 2016031911 | 3/2016 |

OTHER PUBLICATIONS

Korean Intellectual Property Office Application No. 10-2021-0063504, Office Action dated Oct. 16, 2022, 5 pages.
Japan Patent Office Application No. 2021-196690, Office Action dated Aug. 30, 2022,4 pages.

* cited by examiner

DISPLAY DEVICE AND METHOD OF OPERATING THE SAME

CROSS-REFERENCE TO RELATED APPLICATIONS

Pursuant to 35 U.S.C. § 119 (a), this application claims the benefit of an earlier filing date and right of priority to Korean Patent Application No. 10-2021-0063504 filed on May 17, 2021, the contents of which is hereby incorporated by reference herein in its entirety.

BACKGROUND

The present disclosure relates to a display device and a method of operating the same and, more particularly, to gamut mapping.

Gamut which can be displayed by a display device such as a TV is developed according to gamut defined in the industrial standard. Accordingly, the display device may perform gamut mapping in order to display inexpressible color of gamut defined in the industrial standard.

However, most of content provided by general content producers does not use gamut defined in the standard. Specifically, most of the content uses gamut narrower than gamut provided by the display device.

Nevertheless, since gamut mapping is performed regardless of gamut of input content, unnecessary gamut compression may occur.

SUMMARY

The present disclosure provides a display device for minimizing unnecessary gamut compression and a method of operating the same.

The present disclosure provides a display device for outputting an image with maximum gamut according to an input image, by differently applying a degree of gamut compression according to the input image, and a method of operating the same.

A display device according to an embodiment of the present application comprises a storage configured to store gamut mapping data, a controller configured to, when an image signal is input, convert the input image signal into an output signal based on the gamut mapping data, and a display configured to display an image based on the output signal, wherein the controller changes the gamut mapping data according to the input image signal.

The gamut mapping data comprises a gamut mapping lookup table or a gamut mapping curve.

The controller changes the gamut mapping data based on gamut of the input image signal and the gamut of the display.

The controller converts the output signal to be the same as the input image signal, when gamut of the input image signal is narrower than gamut of the display.

The controller changes the gamut mapping data such that the input signal is output being without being compressed, when the gamut of the input image signal is narrower than the gamut of the display.

The controller changes the gamut mapping data such that the input signal is compressed into gamut of the display through conversion, when gamut of the input image signal is wider than gamut of the display.

The controller adjusts a compression rate based on a difference between the gamut of the input image signal and the gamut of the display.

The controller increases the compression rate as the difference between the gamut of the input image signal and the gamut of the display increases.

The controller changes the gamut mapping data in consideration of gamut of a signal to be corrected, when the input image signal is corrected for image quality improvement.

When an image signal in which a first area corresponds to a limit of gamut of the display and a second area includes entire gamut of the display is input, output in the first area has a first color, and when an image signal in which a first area corresponds to a limit of gamut of the display and a second area includes a color outside gamut of the display is input, output in the first area has a second color, and the first color and the second color are different.

A method of operating a display device according to an embodiment of the present application comprises storing gamut mapping data, receiving an image signal as input, changing the gamut mapping data according to the input image signal, converting the input image signal into an output signal based on the changed gamut mapping data, and displaying an image based on the output signal.

The changing the gamut mapping data comprises changing the gamut mapping data based on gamut of the input image signal and gamut of the display.

The changing the gamut mapping data comprises changing the gamut mapping data such that the input signal is output without being compressed, when gamut of the input image signal is narrower than gamut of the display.

The changing the gamut mapping data comprises changing the gamut mapping data such that the input signal is compressed into gamut of the display through conversion, when gamut of the input image signal is wider than gamut of the display.

The changing the gamut mapping data further comprises adjusting a compression rate based on a difference between the gamut of the input image signal and the gamut of the display.

DETAILED DESCRIPTION OF THE EMBODIMENTS

Hereinafter, embodiments relating to the present disclosure will be described in detail with reference to the accompanying drawings. The suffixes "module" and "interface" for components used in the description below are assigned or mixed in consideration of easiness in writing the specification and do not have distinctive meanings or roles by themselves.

Figure 1:
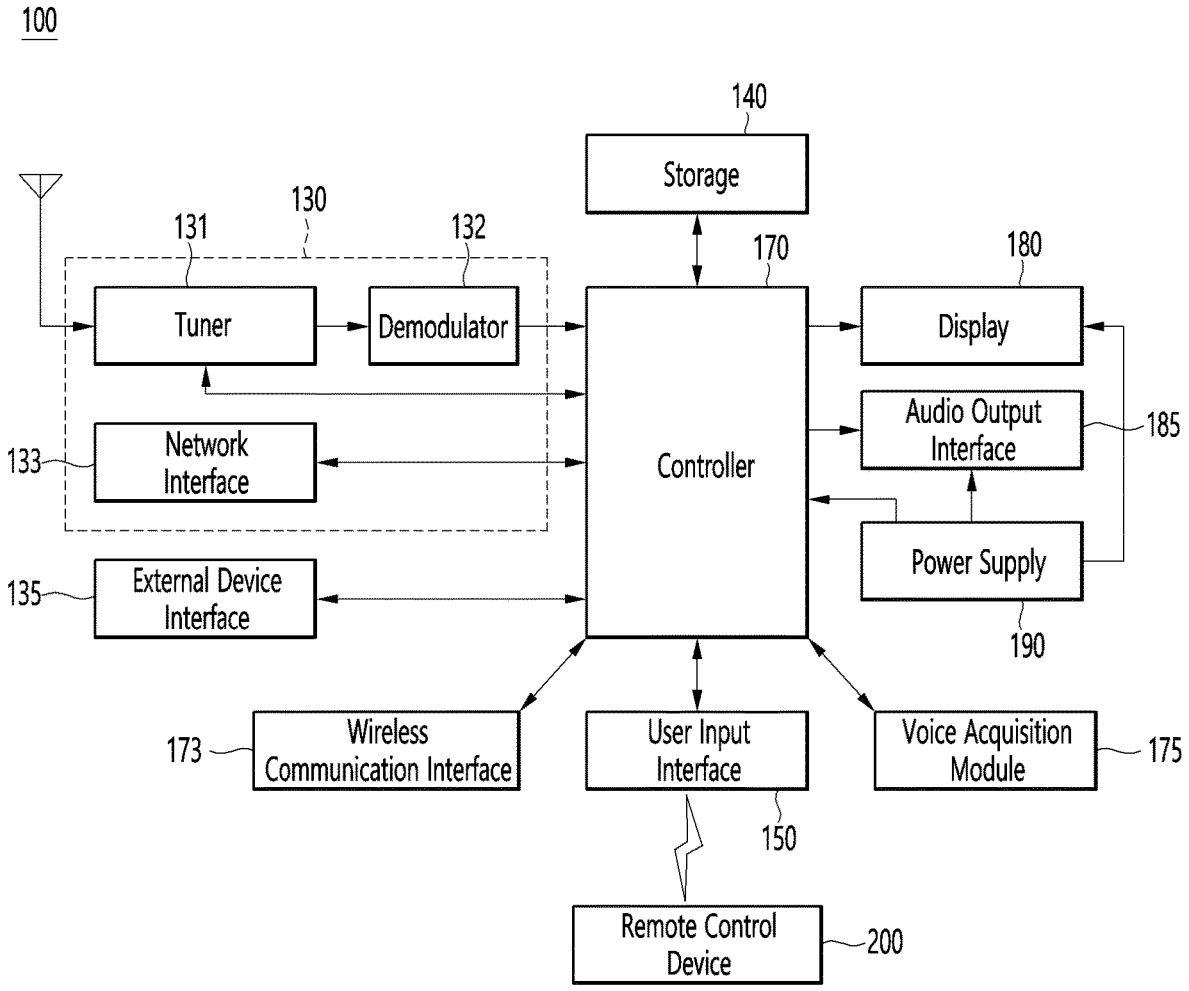
FIG. 1 is a block diagram illustrating a configuration of a display device according to an embodiment of the present disclosure.

FIG. 1 is a block diagram illustrating a configuration of a display device according to an embodiment of the present disclosure.

Referring to FIG. 1, a display device 100 can include a broadcast reception module 130, an external device interface 135, a storage 140, a user input interface 150, a controller 170, a wireless communication interface 173, a voice acquisition module 175, a display 180, an audio output interface 185, and a power supply 190.

The broadcast reception module 130 can include a tuner 131, a demodulator 132, and a network interface 133.

The tuner 131 can select a specific broadcast channel according to a channel selection command. The tuner 131 can receive broadcast signals for the selected specific broadcast channel.

The demodulator 132 can divide the received broadcast signals into video signals, audio signals, and broadcast program related data signals and restore the divided video signals, audio signals, and data signals to an output available form.

The network interface 133 can provide an interface for connecting the display device 100 to a wired/wireless network including internet network. The network interface 133 can transmit or receive data to or from another user or another electronic device through an accessed network or another network linked to the accessed network.

The network interface 133 can access a predetermined webpage through an accessed network or another network linked to the accessed network. That is, it can transmit or receive data to or from a corresponding server by accessing a predetermined webpage through network.

Then, the network interface 133 can receive contents or data provided from a content provider or a network operator. That is, the network interface 133 can receive contents such as movies, advertisements, games, VODs, and broadcast signals, which are provided from a content provider or a network provider, through network and information relating thereto.

Additionally, the network interface 133 can receive firmware update information and update files provided from a network operator and transmit data to an internet or content provider or a network operator.

The network interface 133 can select and receive a desired application among applications open to the air, through network.

The external device interface 135 can receive an application or an application list in an adjacent external device and deliver it to the controller 170 or the storage 140.

The external device interface 135 can provide a connection path between the display device 100 and an external device. The external device interface 135 can receive at least one of image and audio outputted from an external device that is wirelessly or wiredly connected to the display device 100 and deliver it to the controller. The external device interface 135 can include a plurality of external input terminals. The plurality of external input terminals can include an RGB terminal, at least one High Definition Multimedia Interface (HDMI) terminal, and a component terminal.

An image signal of an external device inputted through the external device interface 135 can be outputted through the display 180. A sound signal of an external device inputted through the external device interface 135 can be outputted through the audio output interface 185.

An external device connectable to the external device interface 135 can be one of a set-top box, a Blu-ray player, a DVD player, a game console, a sound bar, a smartphone, a PC, a USB Memory, and a home theater system but this is just exemplary.

Additionally, some content data stored in the display device 100 can be transmitted to a user or an electronic device, which is selected from other users or other electronic devices pre-registered in the display device 100.

The storage 140 can store signal-processed image, voice, or data signals stored by a program in order for each signal processing and control in the controller 170.

Additionally, the storage 140 can perform a function for temporarily store image, voice, or data signals outputted from the external device interface 135 or the network interface 133 and can store information on a predetermined image through a channel memory function.

The storage 140 can store an application or an application list inputted from the external device interface 135 or the network interface 133.

The display device 100 can play content files (for example, video files, still image files, music files, document files, application files, and so on) stored in the storage 140 and provide them to a user.

The user input interface 150 can deliver signals inputted from a user to the controller 170 or deliver signals from the controller 170 to a user. For example, the user input interface 150 can receive or process control signals such as power on/off, channel selection, and screen setting from the remote control device 200 or transmit control signals from the controller 170 to the remote control device 200 according to various communication methods such as Bluetooth, Ultra Wideband (WB), ZigBee, Radio Frequency (RF), and IR.

Additionally, the user input interface 150 can deliver, to the controller 170, control signals inputted from local keys (not shown) such as a power key, a channel key, a volume key, and a setting key.

Image signals that are image-processed in the controller 170 can be inputted to the display 180 and displayed as an image corresponding to corresponding image signals. Additionally, image signals that are image-processed in the controller 170 can be inputted to an external output device through the external device interface 135.

Voice signals processed in the controller 170 can be outputted to the audio output interface 185. Additionally, voice signals processed in the controller 170 can be inputted to an external output device through the external device interface 135.

Besides that, the controller 170 can control overall operations in the display device 100.

Additionally, the controller 170 can control the display device 100 by a user command or internal program inputted through the user input interface 150 and download a desired application or application list into the display device 100 in access to network.

The controller 170 can output channel information selected by a user together with processed image or voice signals through the display 180 or the audio output interface 185.

Additionally, according to an external device image playback command received through the user input interface 150, the controller 170 can output image signals or voice signals of an external device such as a camera or a camcorder, which are inputted through the external device interface 135, through the display 180 or the audio output interface 185.

Moreover, the controller 170 can control the display 180 to display images and control broadcast images inputted through the tuner 131, external input images inputted through the external device interface 135, images inputted through the network interface, or images stored in the storage 140 to be displayed on the display 180. In this case, an image displayed on the display 180 can be a still image or video and also can be a 2D image or a 3D image.

Additionally, the controller 170 can play content stored in the display device 100, received broadcast content, and external input content inputted from the outside, and the content can be in various formats such as broadcast images, external input images, audio files, still images, accessed web screens, and document files.

Moreover, the wireless communication interface 173 can perform a wired or wireless communication with an external electronic device. The wireless communication interface 173 can perform short-range communication with an external device. For this, the wireless communication interface 173 can support short-range communication by using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (USB) technologies. The wireless communication interface 173 can support wireless communication between the display device 100 and a wireless communication system, between the display device 100 and another display device 100, or between networks including the display device 100 and another display device 100 (or an external server) through wireless area networks. The wireless area networks can be wireless personal area networks.

Herein, the other display device 100 can be a mobile terminal such as a wearable device (for example, a smart watch, a smart glass, and a head mounted display (HMD)) or a smartphone, which is capable of exchanging data (or inter-working) with the display device 100. The wireless communication interface 173 can detect (or recognize) a communicable wearable device around the display device 100. Furthermore, if the detected wearable device is a device authenticated to communicate with the display device 100, the controller 170 can transmit at least part of data processed in the display device 100 to the wearable device through the wireless communication interface 173. Accordingly, a user of the wearable device can use the data processed in the display device 100 through the wearable device.

The voice acquisition module 175 can acquire audio. The voice acquisition module 175 may include at least one microphone (not shown), and can acquire audio around the display device 100 through the microphone (not shown).

The display 180 can convert image signals, data signals, or OSD signals, which are processed in the controller 170, or images signals or data signals, which are received in the external device interface 135, into R, G, and B signals to generate driving signals.

Furthermore, the display device 100 shown in FIG. 1 is just one embodiment of the present disclosure and thus, some of the components shown can be integrated, added, or omitted according to the specification of the actually implemented display device 100.

That is, if necessary, two or more components can be integrated into one component or one component can be divided into two or more components and configured. Additionally, a function performed by each block is to describe an embodiment of the present disclosure and its specific operation or device does not limit the scope of the present disclosure.

According to another embodiment of the present disclosure, unlike FIG. 1, the display device 100 can receive images through the network interface 133 or the external device interface 135 and play them without including the tuner 131 and the demodulator 132.

For example, the display device 100 can be divided into an image processing device such as a set-top box for receiving broadcast signals or contents according to various network services and a content playback device for playing contents inputted from the image processing device.

In this case, an operating method of a display device according to an embodiment of the present disclosure described below can be performed by one of the display device described with reference to FIG. 1, an image processing device such as the separated set-top box, and a content playback device including the display 180 and the audio output interface 185.

The audio output interface 185 receives the audio processed signal from the controller 170 and outputs the sound.

The power supply 190 supplies the corresponding power throughout the display device 100. In particular, the power supply 190 supplies power to the controller 170 that can be implemented in the form of a System On Chip (SOC), a display 180 for displaying an image, and the audio output interface 185 for outputting audio or the like.

Specifically, the power supply 190 may include a converter for converting an AC power source into a DC power source, and a DC/DC converter for converting a level of the DC source power.

Figure 2:
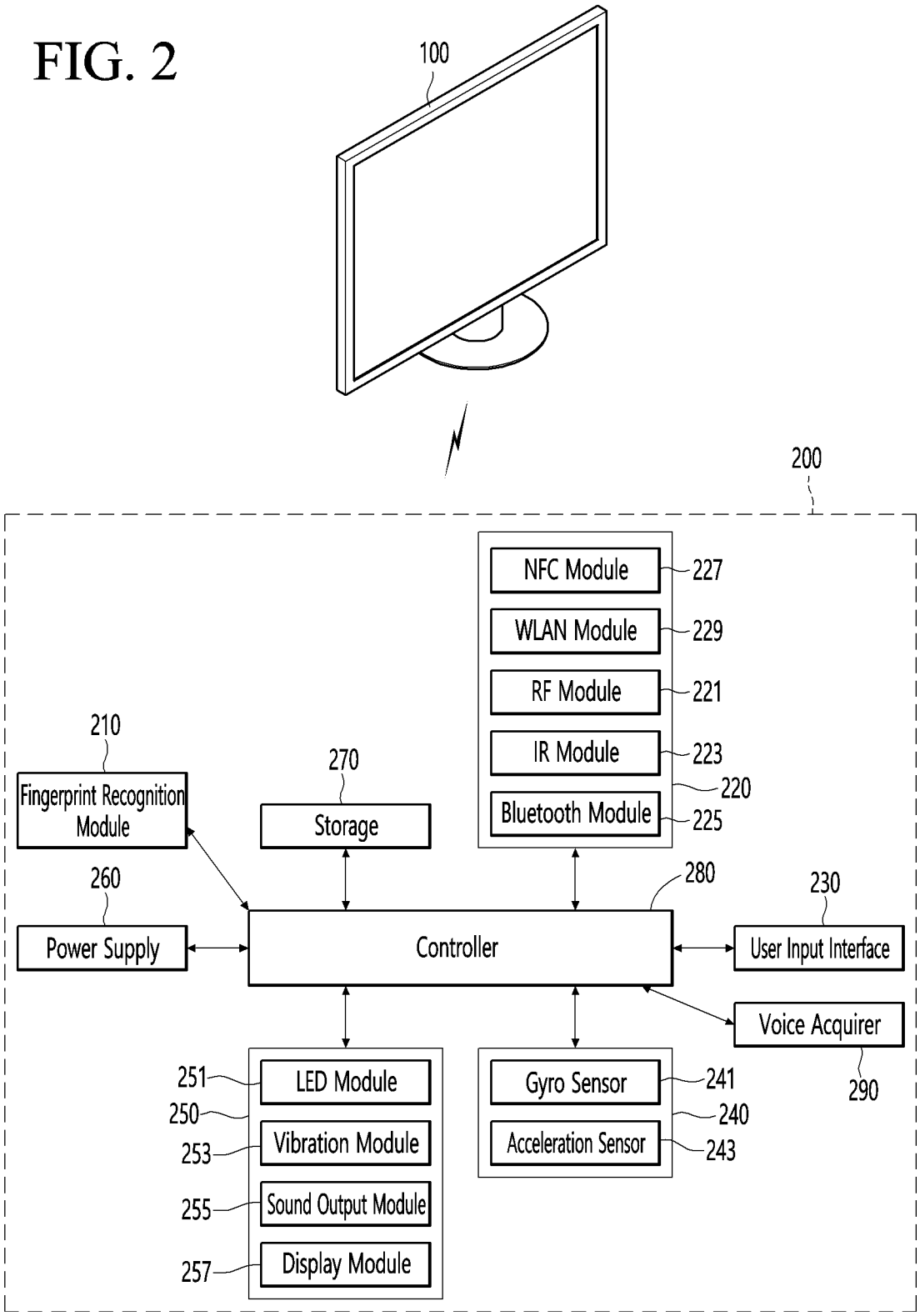
FIG. 2 is a block diagram illustrating a remote control device according to an embodiment of the present disclosure.
Figure 3:
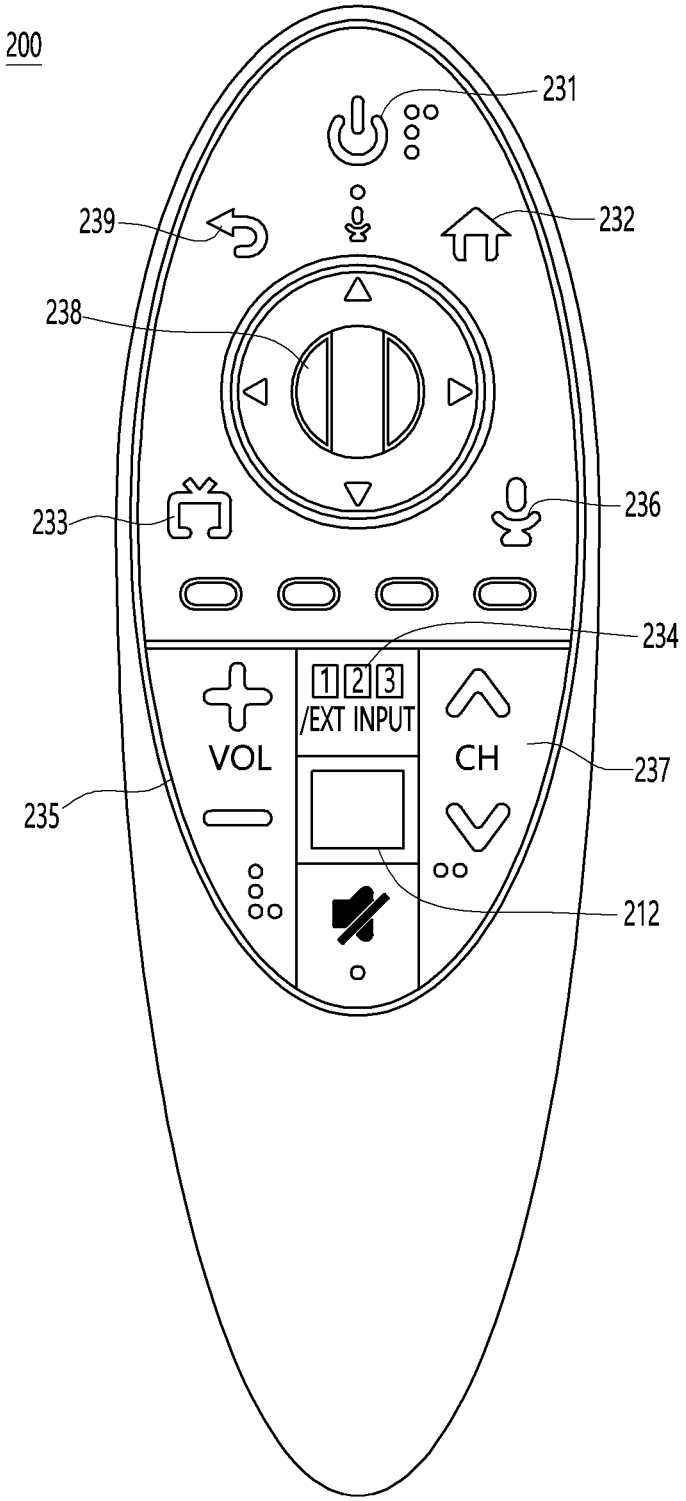
FIG. 3 is a view illustrating an actual configuration of a remote control device according to an embodiment of the present disclosure.

Then, referring to FIGS. 2 and 3, a remote control device is described according to an embodiment of the present disclosure.

FIG. 2 is a block diagram illustrating a remote control device according to an embodiment of the present disclosure and FIG. 3 is a view illustrating an actual configuration of a remote control device according to an embodiment of the present disclosure.

First, referring to FIG. 2, a remote control device 200 can include a fingerprint recognition module 210, a wireless communication interface 220, a user input interface 230, a sensor 240, an output interface 250, a power supply 260, a storage 270, a controller 280, and a voice acquisition module 290.

Referring to FIG. 2, the wireless communication interface 220 transmits/receives signals to/from an arbitrary any one of display devices according to the above-mentioned embodiments of the present disclosure.

The remote control device 200 can include an RF module 221 for transmitting/receiving signals to/from the display device 100 according to the RF communication standards and an IR module 223 for transmitting/receiving signals to/from the display device 100 according to the IR communication standards. Additionally, the remote control device 200 can include a Bluetooth module 225 for transmitting/receiving signals to/from the display device 100 according to the Bluetooth communication standards. Additionally, the remote control device 200 can include an NFC module 227 for transmitting/receiving signals to/from the display device 100 according to the Near Field Communication (NFC) communication standards and a WLAN module 229 for transmitting/receiving signals to/from the display device 100 according to the Wireless LAN (WLAN) communication standards Additionally, the remote control device 200 can transmit signals containing information on a movement of the remote control device 200 to the display device 100 through the wireless communication interface 220.

Moreover, the remote control device 200 can receive signals transmitted from the display device 100 through the RF module 221 and if necessary, can transmit a command on power on/off, channel change, and volume change to the display device 100 through the IR module 223.

The user input interface 230 can be configured with a keypad button, a touch pad, or a touch screen. A user can manipulate the user input interface 230 to input a command relating to the display device 100 to the remote control device 200. If the user input interface 230 includes a hard key button, a user can input a command relating to the display device 100 to the remote control device 200 through the push operation of the hard key button. This will be described with reference to FIG. 3.

Referring to FIG. 3, the remote control device 200 can include a plurality of buttons. The plurality of buttons can include a fingerprint recognition button 212, a power button 231, a home button 232, a live button 233, an external input button 234, a voice adjustment button 235, a voice recognition button 236, a channel change button 237, a check button 238, and a back button 239.

The fingerprint recognition button 212 can be a button for recognizing a user's fingerprint. According to an embodiment of the present disclosure, the fingerprint recognition button 212 can perform a push operation and receive a push operation and a fingerprint recognition operation. The power button 231 can be button for turning on/off the power of the display device 100. The power button 231 can be button for moving to the home screen of the display device 100. The live button 233 can be a button for displaying live broadcast programs. The external input button 234 can be button for receiving an external input connected to the display device 100. The voice adjustment button 235 can be button for adjusting the size of a volume outputted from the display device 100. The voice recognition button 236 can be a button for receiving user's voice and recognizing the received voice. The channel change button 237 can be a button for receiving broadcast signals of a specific broadcast channel. The check button 238 can be a button for selecting a specific function and the back button 239 can be a button for returning to a previous screen.

Again, FIG. 2 is described.

If the user input interface 230 includes a touch screen, a user can touch a soft key of the touch screen to input a command relating to the display device 100 to the remote control device 200. Additionally, the user input interface 230 can include various kinds of input means manipulated by a user, for example, a scroll key and a jog key, and this embodiment does not limit the scope of the present disclosure.

The sensor 240 can include a gyro sensor 241 or an acceleration sensor 243 and the gyro sensor 241 can sense information on a movement of the remote control device 200.

For example, the gyro sensor 241 can sense information on an operation of the remote control device 200 on the basis of x, y, and z axes and the acceleration sensor 243 can sense information on a movement speed of the remote control device 200. Moreover, the remote control device 200 can further include a distance measurement sensor and sense a distance with respect to the display 180 of the display device 100.

The output interface 250 can output image or voice signals corresponding to a manipulation of the user input interface 230 or corresponding to signals transmitted from the display device 100. A user can recognize whether the user input interface 230 is manipulated or the display device 100 is controlled through the output interface 250.

For example, the output interface 250 can include an LED module 251 for flashing, a vibration module 253 for generating vibration, a sound output module 255 for outputting sound, or a display module 257 for outputting an image, if the user input interface 230 is manipulated or signals are transmitted/received to/from the display device 100 through the wireless communication interface 220.

Additionally, the power supply 260 supplies power to the remote control device 200 and if the remote control device 200 does not move for a predetermined time, stops the power supply, so that power waste can be reduced. The power supply 260 can resume the power supply if a predetermined key provided at the remote control device 200 is manipulated.

The storage 270 can store various kinds of programs and application data necessary for a control or operation of the remote control device 200. If the remote control device 200 transmits/receives signals wirelessly through the display device 100 and the RF module 221, the remote control device 200 and the display device 100 transmits/receives signals through a predetermined frequency band.

The controller 280 of the remote control device 200 can store, in the storage 270, information on a frequency band for transmitting/receiving signals to/from the display device 100 paired with the remote control device 200 and refer to it.

The controller 280 controls general matters relating to a control of the remote control device 200. The controller 280 can transmit a signal corresponding to a predetermined key manipulation of the user input interface 230 or a signal corresponding to a movement of the remote control device 200 sensed by the sensor 240 to the display device 100 through the wireless communication interface 220.

Additionally, the voice acquisition module 290 of the remote control device 200 can obtain voice.

The voice acquisition module 290 can include at least one microphone 291 and obtain voice through the microphone 291.

Figure 4:
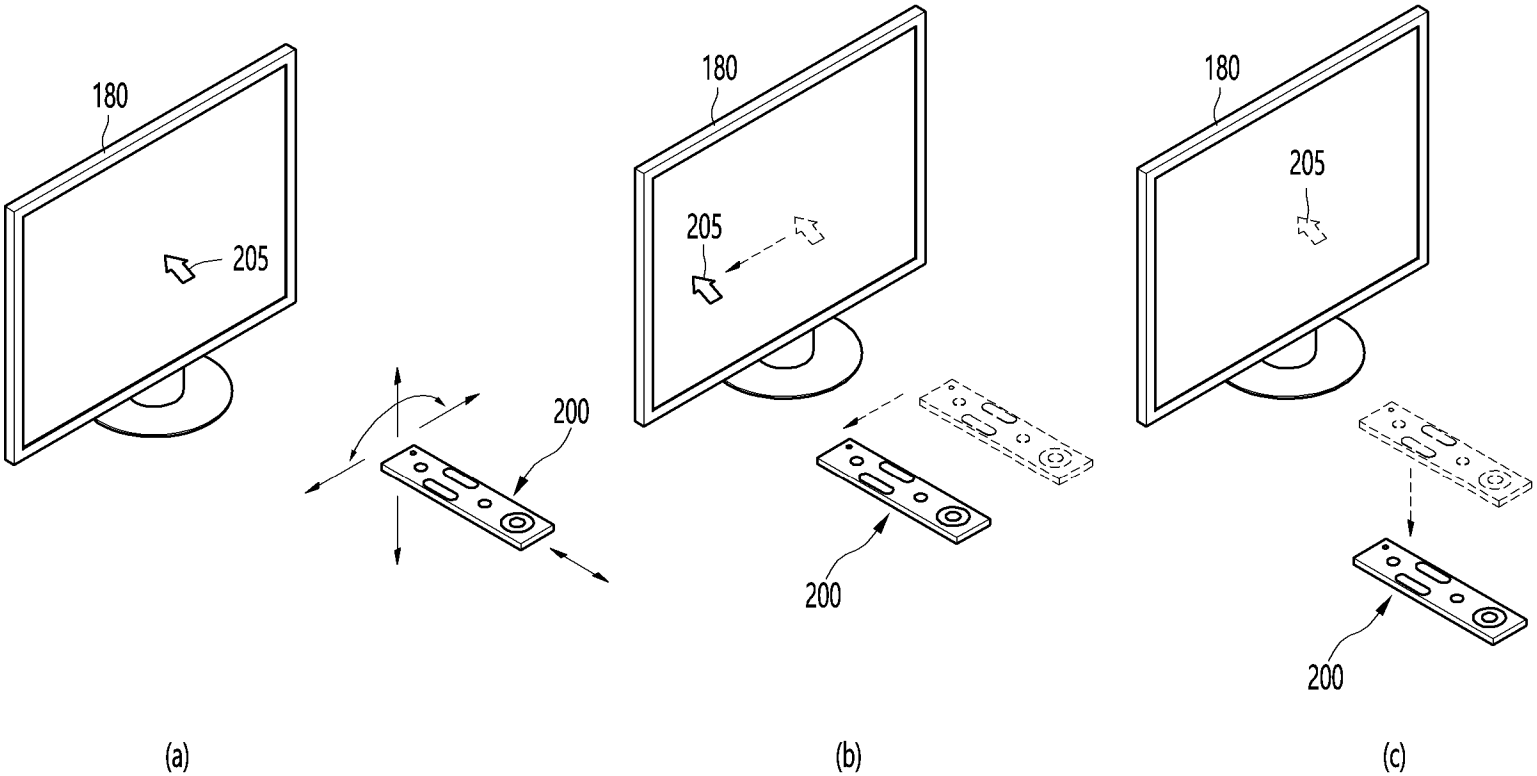
FIG. 4 is a view of utilizing a remote control device according to an embodiment of the present disclosure.

Then, FIG. 4 is described.

FIG. 4 is a view of utilizing a remote control device according to an embodiment of the present disclosure.

FIG. 4A illustrates that a pointer 205 corresponding to the remote control device 200 is displayed on the display 180.

A user can move or rotate the remote control device 200 vertically or horizontally. The pointer 205 displayed on the display 180 of the display device 100 corresponds to a movement of the remote control device 200. Since the corresponding pointer 205 is moved and displayed according to a movement on a 3D space as show in the drawing, the remote control device 200 can be referred to as a spatial remote controller.

FIG. 4B illustrates that if a user moves the remote control device 200, the pointer 205 displayed on the display 180 of the display device 100 is moved to the left in correspondence thereto.

Information on a movement of the remote control device 200 detected through a sensor of the remote control device 200 is transmitted to the display device 100. The display device 100 can calculate the coordinates of the pointer 205 from the information on the movement of the remote control device 200. The display device 100 can display the pointer 205 to match the calculated coordinates.

FIG. 4C illustrates that while a specific button in the remote control device 200 is pressed, a user moves the remote control device 200 away from the display 180. Thus, a selection area in the display 180 corresponding to the pointer 205 can be zoomed in and displayed largely.

On the other hand, if a user moves the remote control device 200 close to the display 180, a selection area in the display 180 corresponding to the pointer 205 can be zoomed out and displayed reduced.

On the other hand, if the remote control device 200 is away from the display 180, a selection area can be zoomed out and if the remote control device 200 is close to the display 180, a selection area can be zoomed in.

Additionally, if a specific button in the remote control device 200 is pressed, the recognition of a vertical or horizontal movement can be excluded. That is, if the remote control device 200 is moved away from or close to the display 180, the up, down, left, or right movement can not be recognized and only the back and fourth movement can be recognized. While a specific button in the remote control device 200 is not pressed, only the pointer 205 is moved according to the up, down, left or right movement of the remote control device 200.

Moreover, the moving speed or moving direction of the pointer 205 can correspond to the moving speed or moving direction of the remote control device 200.

Furthermore, a pointer in this specification means an object displayed on the display 180 in correspondence to an operation of the remote control device 200. Accordingly, besides an arrow form displayed as the pointer 205 in the drawing, various forms of objects are possible. For example, the above concept includes a point, a cursor, a prompt, and a thick outline. Then, the pointer 205 can be displayed in correspondence to one point of a horizontal axis and a vertical axis on the display 180 and also can be displayed in correspondence to a plurality of points such as a line and a surface.

Meanwhile, the display device 100 has a limitation in that all colors cannot be reproduced due to technical limitations. Therefore, since the same image may be differently displayed according to the manufacturer of the display device 100 and the performance of the panel, the standard for displaying a predetermined screen may be defined between an image producer and the manufacturer of the display device 100. The display device 100 may output an image through gamut mapping such that the image is displayed according to the standard.

Gamut may be gamut of color. Specifically, the gamut may mean an area in a color space including all colors developed in color reproduction.

Gamut mapping may mean operation of converting a color such that an input image is expressed according to the color standard of the image in a range supported by the display device 100. Gamut mapping may be implemented in units of pixels through a separate computing device or prestored data (e.g., 3D-LUT (lookup table)).

Figure 5:
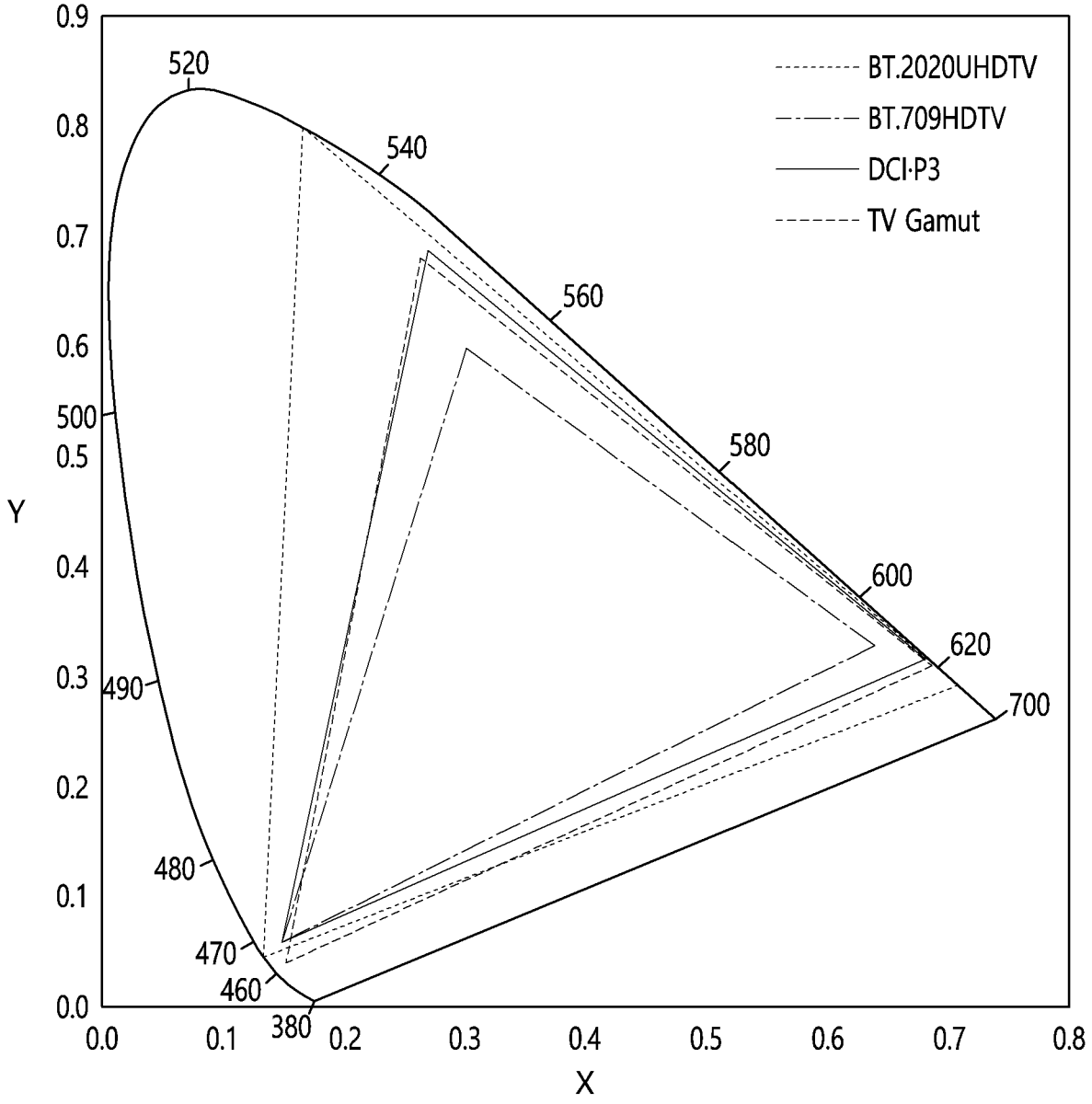
FIG. 5 is a view showing various examples of the color standard and an example of gamut supported by a display device.

FIG. 5 is a view showing various examples of the color standard and an example of gamut supported by a display device.

FIG. 5 shows gamut of each of BT.2020, BT.709 and DCI-P3 as an example of the color standard. BT. 2020 may be the color standard of UHD(4K), BT.709 may be the color standard of digital HDTV, and DCI-P3 may be the color standard of digital cinema.

Meanwhile, the TV Gamut of FIG. 5 is an example of gamut supported by the display device 100. According to the example of FIG. 5, it can be seen that gamut supported by the display device 100 is narrower than that of BT.2020 and is similar to that of BT.709 in terms of the size but a different area is present, and is wider that of DCI-P3.

That is, the gamut of an image input to the display device 100 may exceed the gamut supported by the display device 100. Accordingly, the display device 100 may compress a portion exceeding the expressible gamut and display the compressed portion on the display 180. Compression may be referred to as gamut mapping.

There are various methods in gamut mapping, which will be described with reference to FIGS. 6 to 8.

Figure 6:
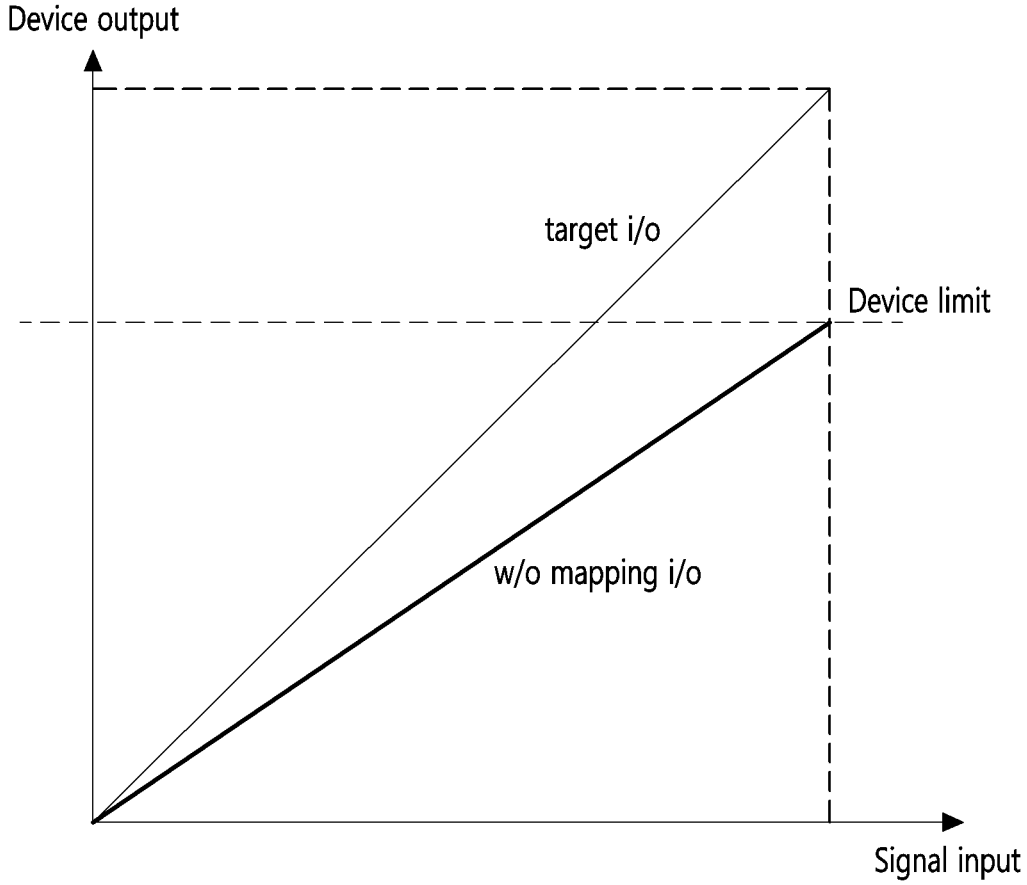
FIG. 6 is a graph showing linear compression among gamut mapping methods.
Figure 7:
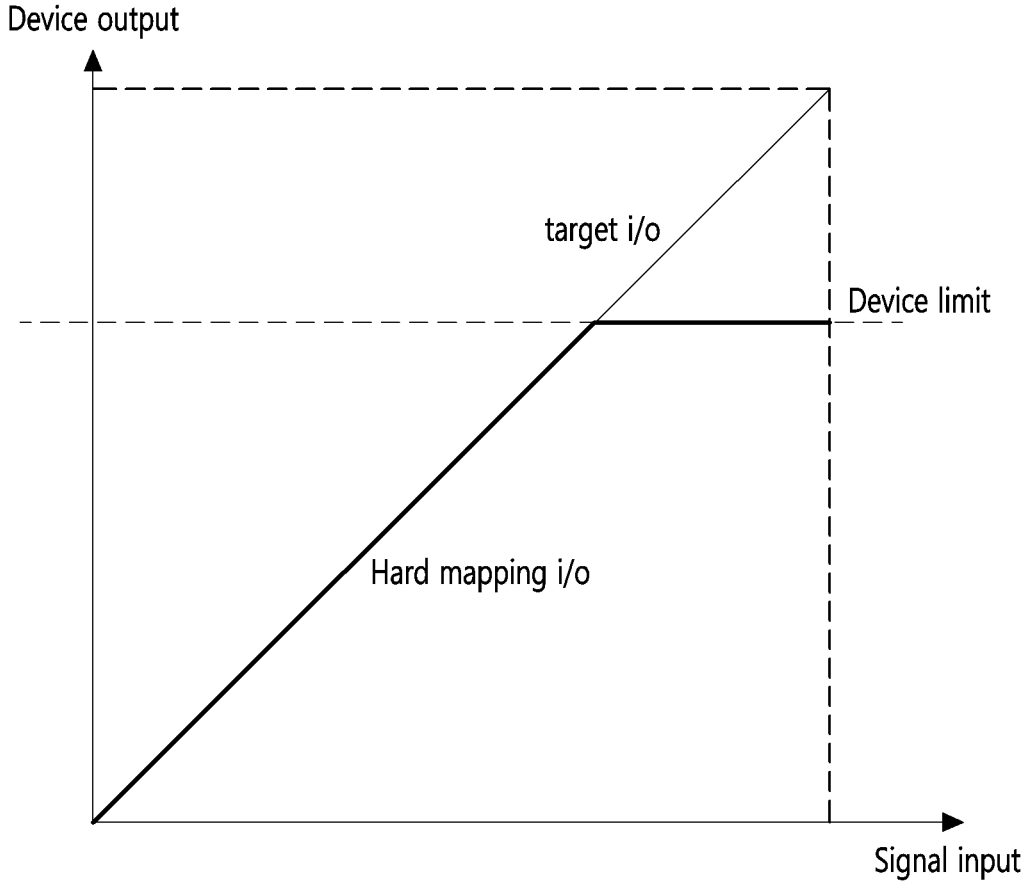
FIG. 7 is a graph showing color gamut clipping among gamut mapping methods.
Figure 8:
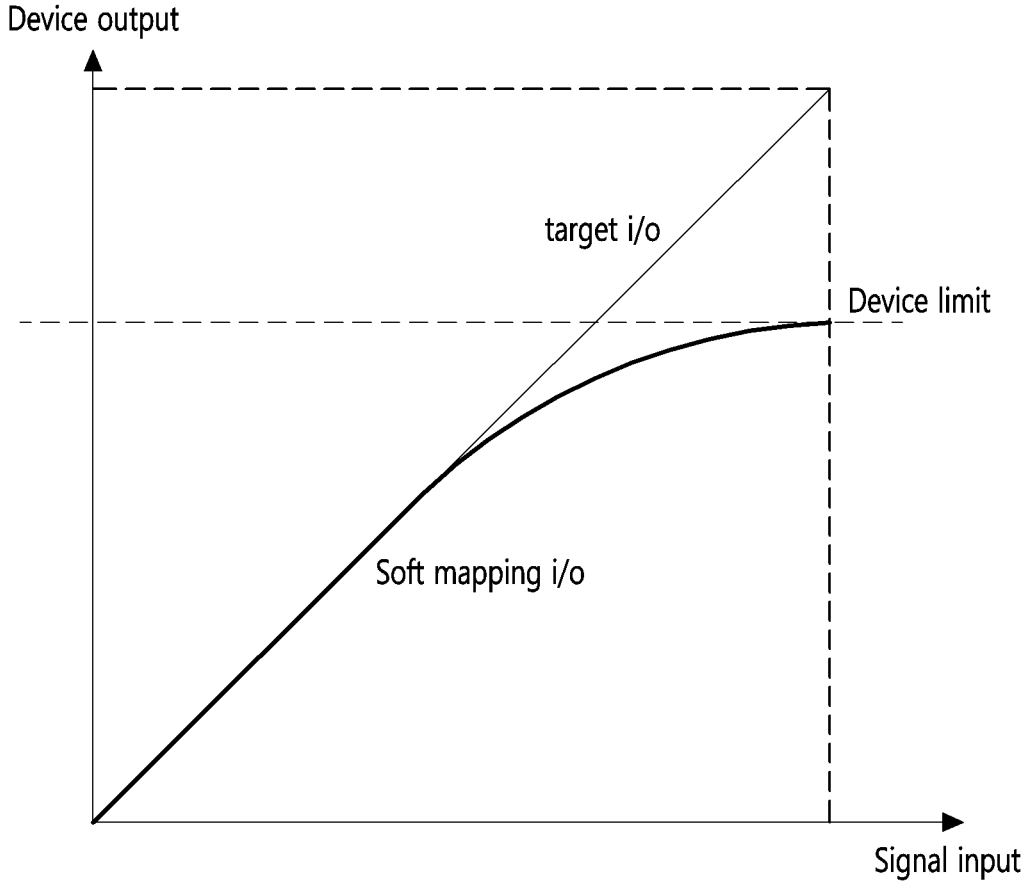
FIG. 8 is a graph showing nonlinear compression among gamut mapping methods.

FIG. 6 is a graph showing linear compression among gamut mapping methods, FIG. 7 is a graph showing color gamut clipping among gamut mapping methods, and FIG. 8 is a graph showing nonlinear compression among gamut mapping methods.

According to linear compression, as shown in FIG. 6, the display device 100 may adjust the maximum and minimum of the brightness or saturation value of an input image to the maximum or minimum of the brightness or saturation value of gamut to be mapped and linearly convert the remaining values. In this case, as even a color expressible by the display device 100 is converted into another color, distortion may occur.

According to color gamut clipping, as shown in FIG. 7, the display device 100 may map a color outside expressible gamut to a boundary area of gamut to be mapped. In this case, since no change occurs in a color inside the expressible gamut, nonlinearity with the color inside the gamut may occur when reproducing the color outside the gamut.

According to nonlinear compression, as shown in FIG. 8, the display device 100 may map an input image according to a prestored nonlinear function. In this case, unnecessary distortion in which some of colors expressible by the display device 100 are expressed in different colors may occur. In particular, when the gamut of the input image is included in the gamut supported by the display device 100, although compression is unnecessary, mapping may be performed according to the nonlinear function and thus unnecessary distortion may occur.

Figure 9:
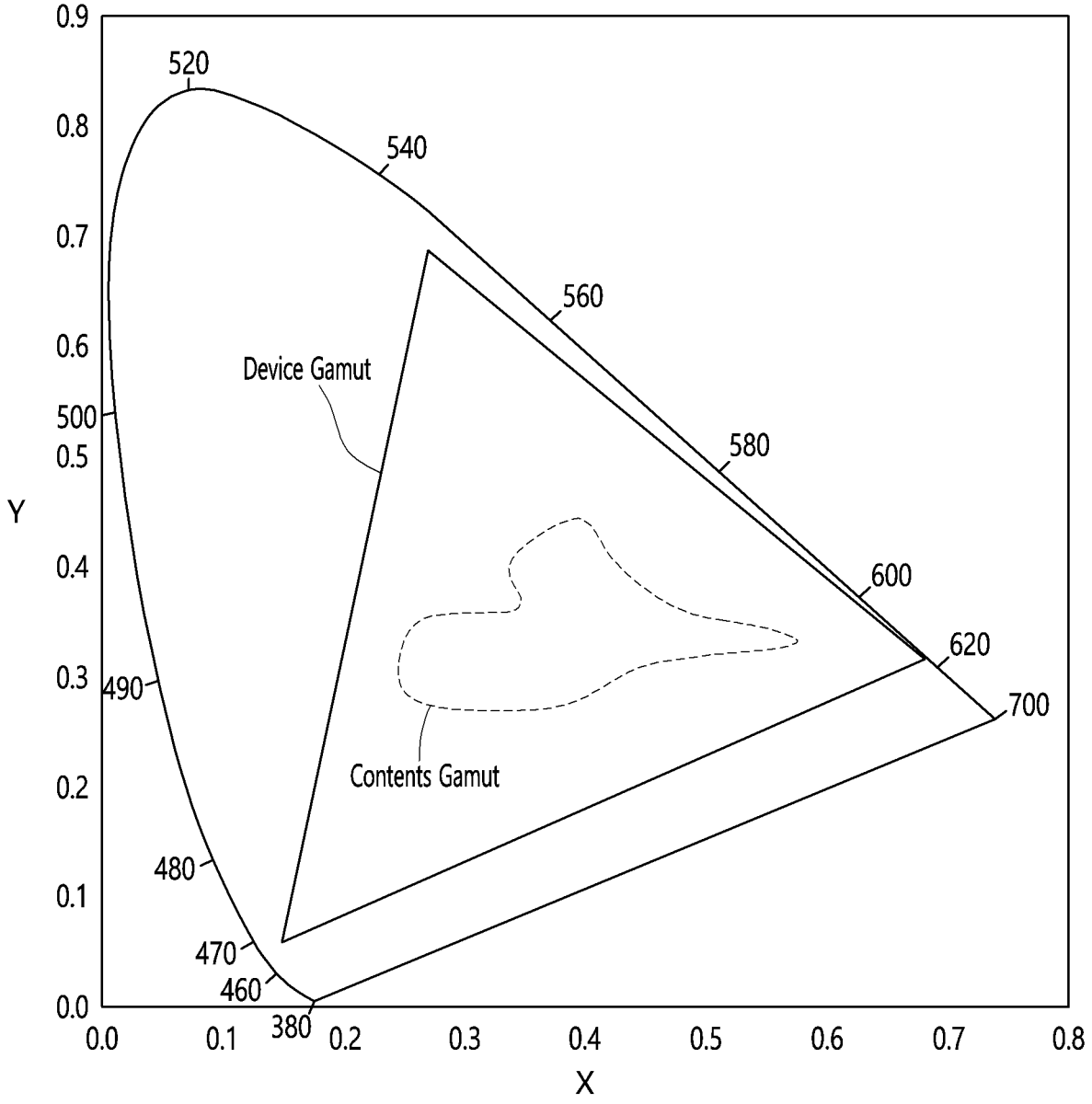
FIG. 9 is a view showing the case where content gamut is included in gamut supported by a display device.

FIG. 9 is a view showing the case where content gamut is included in gamut supported by a display device.

As shown in FIG. 9, there are many cases where gamut of content (Contents Gamut) is included in gamut of the display device (Device Gamut). Nevertheless, when the display device 100 performs gamut mapping according to nonlinear compression, distortion unnecessary for an image, that is, unnecessary gamut compression, may occur.

Therefore, in the present disclosure, gamut mapping is not fixedly performed, but gamut mapping is performed according to the input image in various manners.

Figure 10:
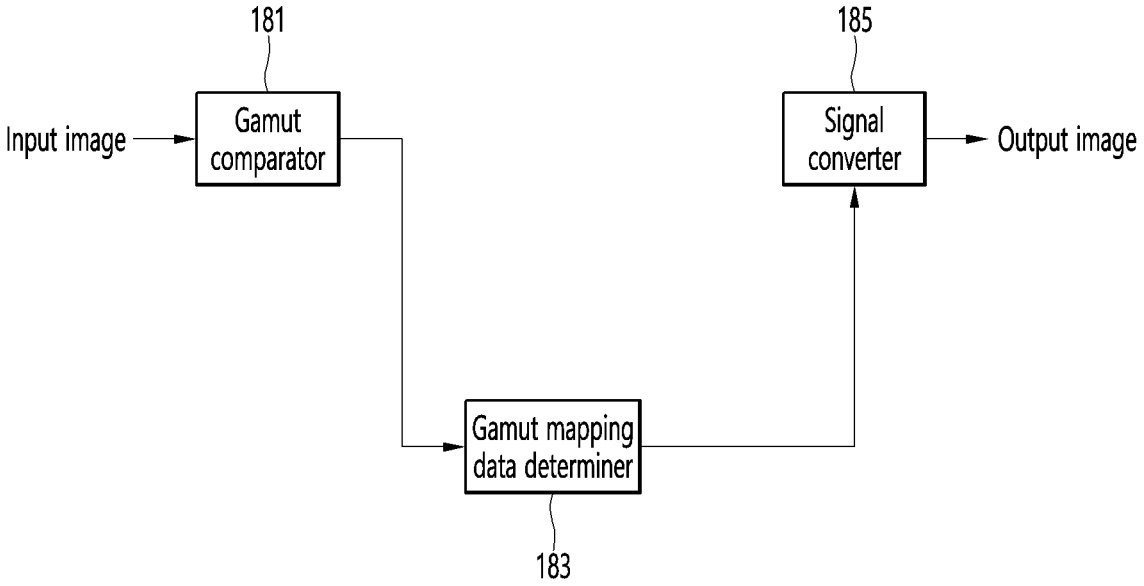
FIG. 10 is a block diagram illustrating a method of performing gamut mapping by a display device according to an embodiment of the present disclosure.

FIG. 10 is a block diagram illustrating a method of performing gamut mapping by a display device according to an embodiment of the present disclosure.

As shown in FIG. 10, the display device 100 may include a gamut comparator 181, a gamut mapping data determiner 182 and a signal converter 185. The gamut comparator 181, the gamut mapping data determiner 183 and the signal converter 185 may be included in the controller 170 or the display 180. That is, each of the gamut comparator 181, the gamut mapping data determiner 183 and the signal converter 185 may be an component of the controller 170 or an component of the display 180. However, this is merely an example for convenience of description and the present disclosure is not limited thereto. In the present specification, it is assumed that each component of FIG. 10 is a component of the controller 170.

Meanwhile, the storage 140 may store gamut mapping data.

The gamut mapping data is data for gamut mapping and may be data for converting pixel values of an input signal into pixel values to be output from the display 180.

The gamut mapping data may be stored in the form of a lookup table or a curve. That is, the gamut mapping data may include a gamut mapping lookup table or a gamut mapping curve.

When an image signal is input, the controller 170 may convert the input image signal into an output signal based on the gamut mapping data.

Specifically, the gamut comparator 181 may receive the image signal as input. The gamut comparator 181 may compare gamut of the input image signal with gamut of the display device 100. Specifically, when the image signal is input, the gamut comparator 181 may obtain pixel data and the color standard of a corresponding image from the image signal and obtain the gamut of the input image signal based on the pixel data and the color standard. The pixel data means the pixel value of each pixel and the color standard may be the above-described BT.2020, BT.709 or DCI-P3, without being limited thereto. The gamut comparator 181 may compare the gamut of the input image signal with the gamut of the display device 100. More specifically, the gamut comparator 181 may determine whether the gamut of the input image signal is narrower or wider than the gamut of the display device 100. In addition, when the gamut of the input image signal is wider than the gamut of the display device 100, the gamut comparator 181 may obtain a difference between gamuts. That is, when the gamut of the input image signal is first gamut and the gamut of the display device 100 is second gamut, the gamut comparator 181 may calculate a difference between the first gamut and the second gamut. The gamut comparator 181 may determine how wider the first gamut is than the second gamut.

The gamut mapping data determiner 183 may determine the gamut mapping data based on the gamut of the input image signal and the gamut of the display device 100. That is, the gamut mapping data determiner 183 may change prestored gamut mapping data based on the gamut of the input image signal and the gamut of the display device 100.

In some embodiments, the display device 100 may generate the gamut mapping data based on the image signal whenever the image signal is input, without storing the gamut mapping data.

The signal converter 185 may convert the input image signal into an output signal based on the gamut mapping data. The display 180 may display the image according to the output signal.

According to the embodiment of the present disclosure, by differently applying the gamut mapping data according to the input image, it is possible to display the image in various colors while minimizing unnecessary image distortion.

Meanwhile, the display device 100 may correct a signal before outputting the image, for the purpose of image quality improvement. For example, the controller 170 may correct the input image signal in order to adjust hue, saturation or value. When correction is performed, the gamut of the image signal may be different from the gamut of the image signal input to the gamut comparator 181, and may be different from the gamut of the image signal input to the gamut comparator 181. Accordingly, the controller 170 may determine the gamut mapping data by predicting the image signal to be corrected.

Figure 11:
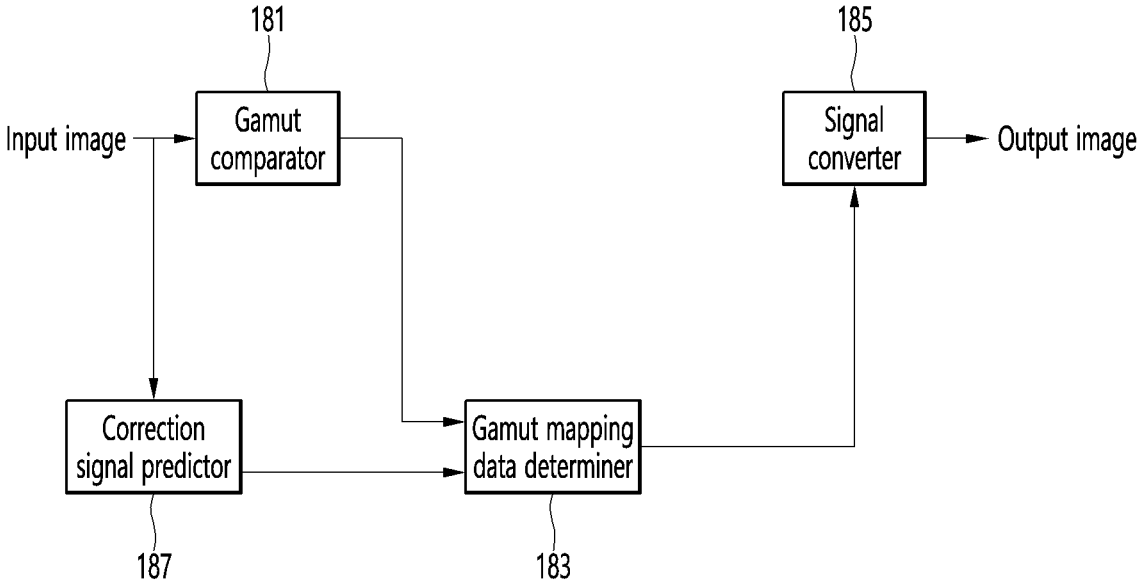
FIG. 11 is a block diagram illustrating a method of performing gamut mapping by a display device according to another embodiment of the present disclosure.

FIG. 11 is a block diagram illustrating a method of performing gamut mapping by a display device according to another embodiment of the present disclosure.

As shown in FIG. 11, the display device 100 may include a gamut comparator 181, a gamut mapping data determiner 183, a signal converter 185 and a correction signal predictor 187. That is, the display device 100 may further include the correction signal predictor 187 as compared to FIG. 10. A description of portions overlapping the portions of FIG. 10 will be omitted.

The correction signal predictor 187 may predict a result of correcting the input image signal. That is, when the input image signal is corrected for image quality improvement, the correction signal predictor 187 may calculate gamut of a signal to be corrected. Therefore, the gamut mapping data determiner 183 may determine the gamut mapping data based on at least one of the gamut of the signal to be corrected, the gamut of the input image signal or the gamut of the display device 100.

That is, when the gamut of the input image signal is first gamut, the gamut of the display device 100 is second gamut and the gamut of the image signal to be corrected is third gamut, the controller 170 may determine the gamut mapping data based on the first gamut to the third gamut. The controller 170 may determine the gamut mapping data based on a difference between the first gamut and the second gamut and the third gamut.

The controller 170 may convert an input signal into an output signal based on the determined gamut mapping data and perform the display 180 to display an image according to the output signal.

In this case, it is possible to minimize a problem in which at least some colors are saturated with specific colors after gamut mapping due to correction of the image signal.

Figure 12:
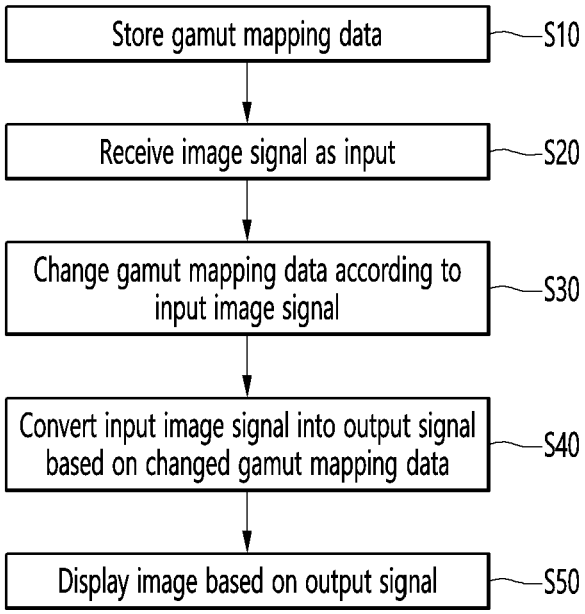
FIG. 12 is a flowchart illustrating a method of operating a display device according to an embodiment of the present disclosure.

FIG. 12 is a flowchart illustrating a method of operating a display device according to an embodiment of the present disclosure.

The controller 170 may store the gamut mapping data (S10).

The controller 170 may receive an image signal as input (S20).

The controller 170 may change the gamut mapping data according to the input image signal (S30).

According to an embodiment, the controller 170 may change the gamut mapping data based on the gamut of the input image signal and the gamut of the display 180.

According to another embodiment, the controller 170 may change the gamut mapping data based on the gamut of the input image signal, the gamut of the image signal to be corrected and the gamut of the display 180. That is, when the input image signal is corrected for image quality improvement, the controller 170 may change the gamut mapping data in consideration of the gamut of the signal to be corrected.

When the gamut of the input image signal (or the gamut of the image signal to be corrected) is narrower than the gamut of the display 180, the controller 170 may convert the output signal to be the same as the input image signal. That is, when the gamut of the input image signal (or the gamut of the image signal to be corrected) is narrower than the gamut of the display 180, the controller 170 may output the image according to the input image signal. That is, when the gamut of the input image signal (or the gamut of the image signal to be corrected) is narrower than the gamut of the display 180, the controller 170 may change the gamut mapping data for one-to-one mapping. When the gamut of the input image signal (or the gamut of the image signal to be corrected) is narrower than the gamut of the display 180, the controller 170 may change the gamut mapping data such that the input signal is output without being compressed.

Meanwhile, when the gamut of the input image signal (or the gamut of the image signal to be corrected) is wider than the gamut of the display 180, the controller 170 may change the gamut mapping data such that the input signal is compressed into the gamut of the display 180 through conversion. The controller 170 may adjust a compression rate based on a difference between the gamut of the input image signal (or the gamut of the image signal to be corrected) and the gamut of the display 180. For example, the controller 170 may increase the compression rate as the difference between the gamut of the input image signal (or the gamut of the image signal to be corrected) and the gamut of the display 180 increases, and decrease the compression rate as the difference between the gamut of the input image signal (or the gamut of the image signal to be corrected) and the gamut of the display 180 decreases.

The controller 170 may convert the input image signal into the output signal based on the changed gamut mapping data (S40).

The controller 170 may display the image based on the output signal (S50).

The display 180 may display the image based on the output signal.

That is, the controller 170 may change the gamut mapping data according to the input image signal. Therefore, it is possible to minimize unnecessary image compression and to display an image in as many colors as possible according to the input image signal.

Figure 13:
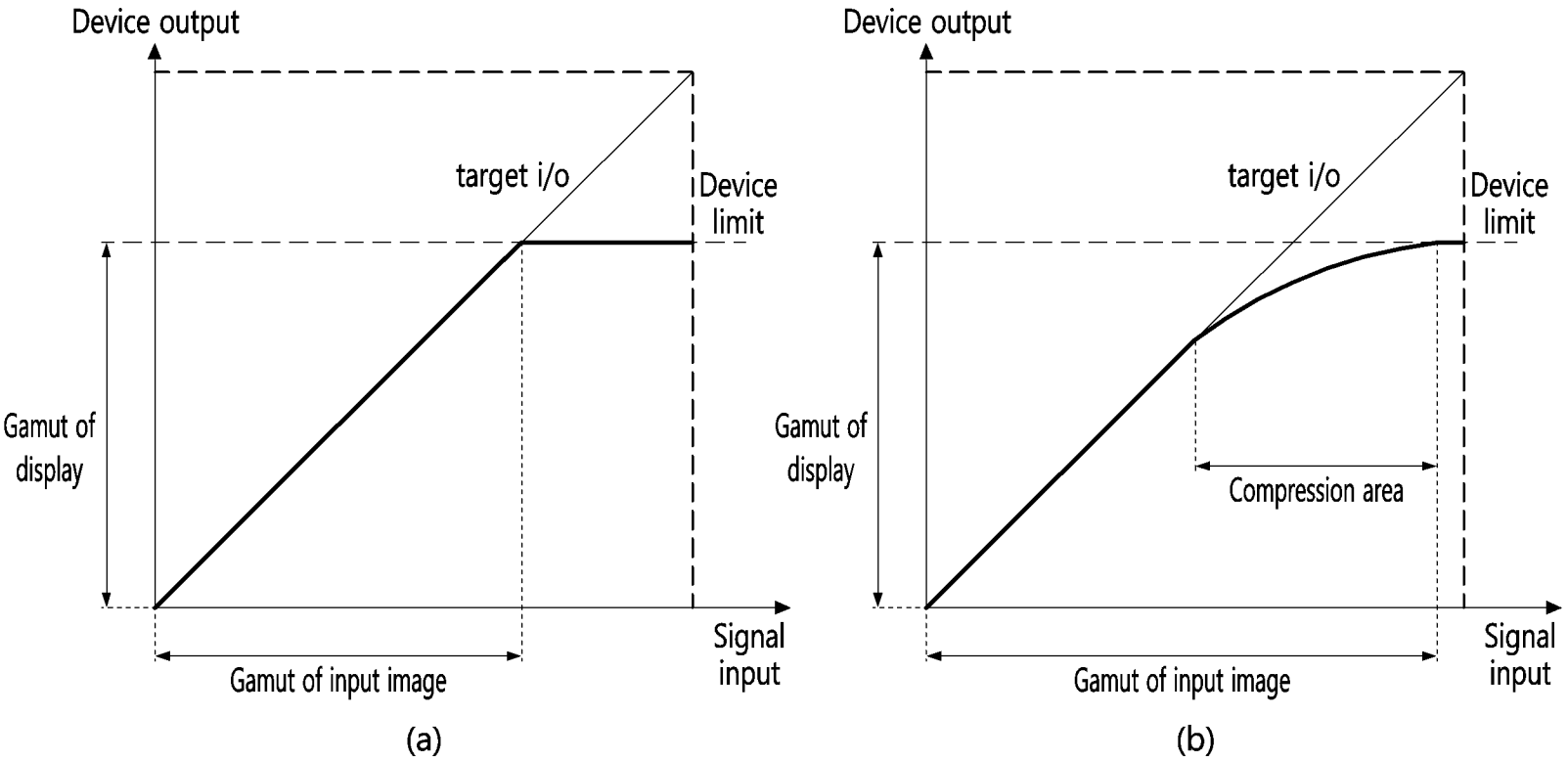
FIGS. 13 to 14 are views illustrating gamut mapping data according to an embodiment of the present disclosure.
Figure 14:
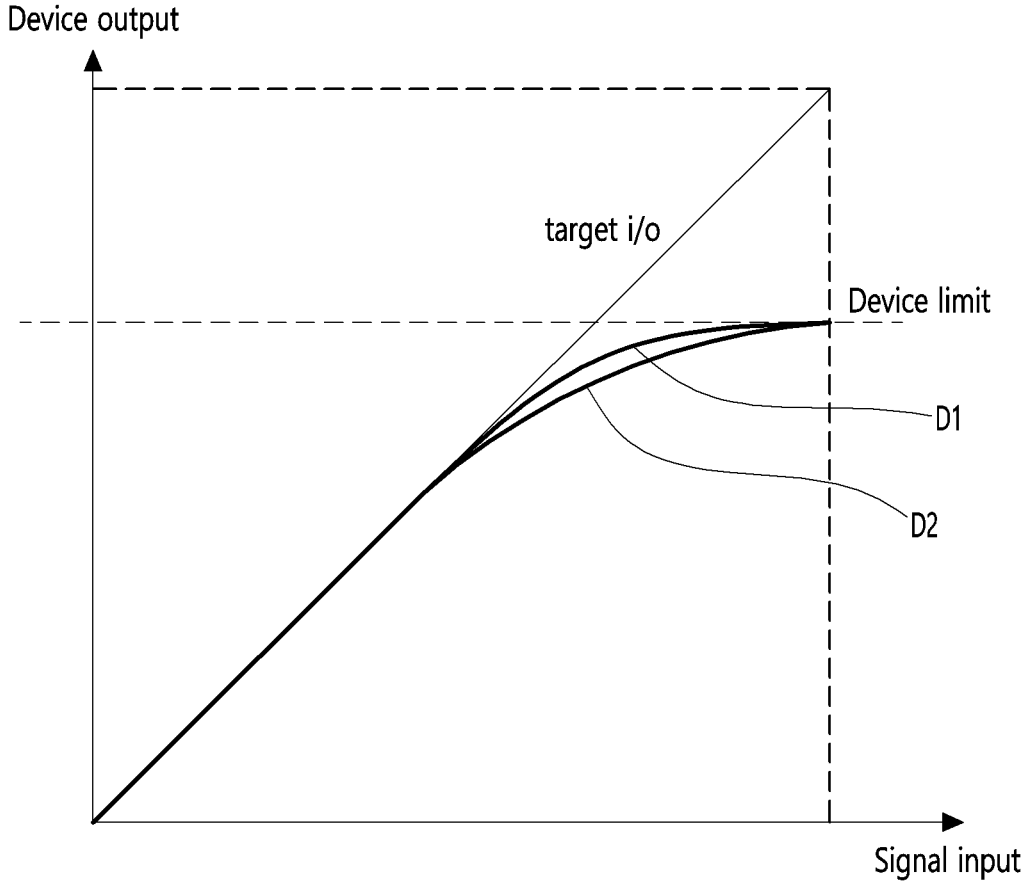

FIGS. 13 to 14 are views illustrating gamut mapping data according to an embodiment of the present disclosure.

Although it is assumed that the gamut mapping data is in the form of a curve in FIG. 13, this is merely an example for convenience of description and the present disclosure is not limited thereto.

As shown in (a) of FIG. 13, when the gamut of the input image signal is narrower than or equal to the gamut of the display 180, the gamut mapping data may be changed such that the input signal is not output without being compressed.

Meanwhile, as shown in (b) of FIG. 13, when the gamut of the input image signal is wider than the gamut of the display 180, the gamut mapping data may be changed such that the input signal is compressed into the gamut of the display 180.

According to the present disclosure, it is possible to minimize unnecessary compression, by changing the gamut according to the input image.

Meanwhile, in (b) of FIG. 13, compression occurs in at least a partial area, and the gamut mapping data may be finely adjusted according to the input image such that the compression area is minimized.

Referring to the example of FIG. 14, it is assumed that, when a difference between the gamut of the input image signal and the gamut of the display is a first value, the controller 170 changes the gamut mapping data to first gamut mapping data (D1) in which a compression rate of a predetermined area is a first compression rate. When the difference between the gamut of the input image signal and the gamut of the display is a second value greater than the first value, the controller 170 changes the gamut mapping data to second gamut mapping data (D2) in which a compression rate of a predetermined area is a second compression rate. The second compression rate may be greater than the first compression rate.

Therefore, it is possible to improve the color expression power of the input image according to the input image within the gamut supported by the display device 100.

Figure 15:
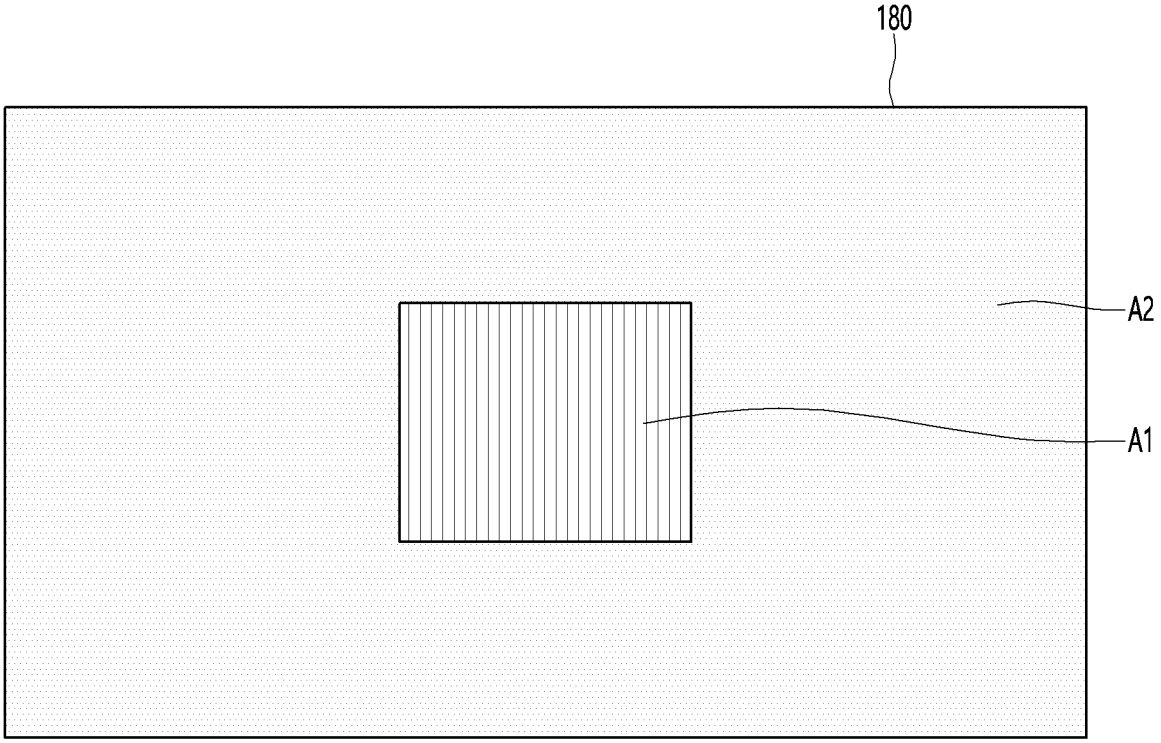
FIG. 15 is a view illustrating that gamut mapping data of a display device according to an embodiment of the present disclosure is changed according to an input image.

This can also be confirmed through measurement such as an example of FIG. 15.

FIG. 15 is a view illustrating that gamut mapping data of a display device according to an embodiment of the present disclosure is changed according to an input image.

For example, first, when an image signal in which a first area A1 corresponds to the limit of the gamut of the display 180 (e.g., an intersection between target i/o and Device limit of FIG. 14) and a second area A2 includes the entire gamut of the display 180 is input, the output in the first area A1 may have a first color.

Second, when an image signal in which the first area A1 has the same color as the first case but the second area A2 includes a color outside the gamut of the display 180 is input, the output in the first area may have a second color.

When the first color and the second color are the same, it can be seen that the gamut mapping data is fixed regardless of the gamut of the input image. However, when the first color and the second color are different, it can be seen that the gamut mapping data is flexible according to the input image.

That is, according to the present disclosure, it is possible to adjust gamut mapping according to an input image and thus it is possible to minimize unnecessary image compression.

According to the embodiment of the present disclosure, since gamut mapping data for gamut mapping is changed according to an input image, it is possible to minimize unnecessary gamut compression.

According to the embodiment of the present disclosure, since gamut mapping is not fixed but is flexibly performed according to an input image, it is possible to output an image with maximum gamut according to the input image.

The present disclosure may be embodied as computer-readable code on a medium having a program recorded thereon. The computer-readable recording medium may be all types of recording devices that can store data which can be read by a computer system. Examples of the computer-readable medium may include a hard disk drive (HDD), a solid state disk (SSD), a silicon disk drive (SDD), a ROM, a RAM, a CD-ROM, a magnetic tape, a floppy disk, and an optical data storage device. Therefore, the detailed description should not be construed as restrictive in all respects and should be considered as illustrative. The scope of this specification should be determined by reasonable interpretation of the appended claims, and all changes within the equivalent scope of this specification are included in the scope of this specification.

The above description is merely illustrative of the technical idea of the present disclosure, and various modifications and changes may be made thereto by those skilled in the art without departing from the essential characteristics of the present disclosure.

Therefore, the embodiments of the present disclosure are not intended to limit the technical spirit of the present disclosure but to illustrate the technical idea of the present disclosure, and the technical spirit of the present disclosure is not limited by these embodiments.

The scope of protection of the present disclosure should be interpreted by the appending claims, and all technical ideas within the scope of equivalents should be construed as falling within the scope of the present disclosure.

What is claimed is:

1. A display device comprising:

a display;

a non-transitory storage medium configured to store gamut mapping data for converting pixel values of an input image signal into pixel values to be output from the display; and a System on Chip (SOC) configured to:

receive an image signal as the input image signal;

based on a gamut of the input image signal being narrower than a gamut of the display, change the stored gamut mapping data such that the input image signal is output without being compressed;

based on the gamut of the input image signal being wider than the gamut of the display, change the stored gamut mapping data such that a color of the input image signal is compressed into the gamut of the display; and acquire an output signal based on the changed gamut mapping data, wherein the input image signal corresponds to an image, and wherein:

based on a first area of the image corresponding to a gamut limit of the display and a second area of the image including the entire gamut of the display, the first area of the image is displayed as having a first color; and based on the first area of the image corresponding to the gamut limit of the display and the second area of the image including a color outside the entire gamut of the display, the first area of the image is displayed as having a second color different from the first color.

2. The display device of claim 1, wherein the gamut mapping data comprises a gamut mapping lookup table or a gamut mapping curve.

3. The display device of claim 1, wherein the SOC is further configured to change the gamut mapping data for a one-to-one mapping, based on the gamut of the input image signal being narrower than the gamut of the display.

4. The display device of claim 1, wherein the SOC is further configured to adjust a compression rate based on a difference between the gamut of the input image signal and the gamut of the display.

5. The display device of claim 4, wherein the SOC is further configured to increase the compression rate as the difference between the gamut of the input image signal and the gamut of the display increases.

6. The display device of claim 1, wherein the SOC is further configured to change the gamut mapping data in consideration of gamut of a signal to be corrected, when the input image signal is corrected for image quality improvement.

7. The display device of claim 1, wherein the gamut mapping data is to convert a color of the input image signal to a color in a range supported by the display.

8. A method of operating a display device including a display, the method comprising:

storing gamut mapping data;

receiving an image signal as an input image signal;

changing the gamut mapping data according to the input image signal;

converting the input image signal into an output signal based on the changed gamut mapping data; and displaying an image based on the output signal, wherein the changing the gamut mapping data comprises:

based on a gamut of the input image signal being narrower than a gamut of the display, changing the stored gamut mapping data such that the input image signal is output without being compressed; and based on the gamut of the input image signal being wider than the gamut of the display, changing the stored gamut mapping data such that a color of the input image signal is compressed into the gamut of the display, wherein the input image signal corresponds to an image, and wherein:

based on a first area of the image corresponding to a gamut limit of the display and a second area of the image including the entire gamut of the display, the first area of the image is displayed as having a first color; and based on the first area of the image corresponding to the gamut limit of the display and the second area of the image including a color outside the entire gamut of the display, the first area of the image is displayed as having a second color different from the first color.

9. The method of claim 8, wherein the changing the gamut mapping data further comprises adjusting a compression rate based on a difference between the gamut of the input image signal and the gamut of the display based on the gamut of input image signal being wider than the gamut of the display.

* * * * *